United States Patent [19]

Czenkusch

[11] Patent Number: 4,891,132

[45] Date of Patent: Jan. 2, 1990

[54] OIL SHALE WET OXIDATION PROCESS

[75] Inventor: Edward L. Czenkusch, Bartlesville, Okla.

[73] Assignee: Phillips Petroleum Company, Bartlesville, Okla.

[21] Appl. No.: 832,619

[22] Filed: Feb. 24, 1986

[51] Int. Cl.[4] ..... C10G 1/00

[52] U.S. Cl. ..... 208/428; 208/391

[58] Field of Search ..... 208/177, 251 R, 407, 208/433, 428, 426, 391; 201/17

[56] References Cited

U.S. PATENT DOCUMENTS

| | | | |
|---|---|---|---|
| 2,907,389 | 10/1959 | Hitzmann | 208/428 |
| 3,824,084 | 7/1974 | Dillon et al. | 44/1 R |
| 3,960,513 | 6/1976 | Agarwal et al. | 44/1 R |
| 4,029,567 | 6/1977 | Farnand et al. | 208/426 |
| 4,176,040 | 11/1979 | Hazlett | 208/428 |
| 4,251,227 | 2/1981 | Othmer | 48/197 R |
| 4,329,156 | 5/1982 | Othmer | 41/15 R |
| 4,431,511 | 2/1984 | Olmstead | 208/428 |
| 4,466,882 | 8/1984 | Audeh et al. | 208/11 LE |
| 4,473,459 | 9/1984 | Bose et al. | 208/391 |
| 4,501,651 | 2/1985 | Audeh et al. | 208/8 R |

OTHER PUBLICATIONS

Chuang et al, "Pyrite Desulfurization by Wet Oxidation in Alkaline Solutions," Chemical Engineering Commun., F(1-3), 79-94 (1980).

Markuszewski et al, "Evaluation of the Removal of Organic Sulfur from Coal"; New Approaches in Coal Chemistry, ACS Syn. Series 169, 1981, pp. 401-414.

D. K. Young et al, "Mild Oxidation of Bioleached Oil Shale", Science and Technology of Oil Shale, T. F. Yen, edit., Ann Arbor Sci. Pub. 1976, pp. 65-71.

D. W. Bennion et al, "A Laboratory Investigation of Wet Combustion in Athabasca Oil Sands", Oil Sands of Canada-Venezuela, 1977.

W. E. Robinson et al, "Oxidation of Colorado Oil Shale", U.S. Bureau of Mines Report Invest. 6166, 1963.

*Primary Examiner*—Glenn Caldarola

*Attorney, Agent, or Firm*—A. W. Umphlett

[57] ABSTRACT

An aqueous slurry of comminuted oil shale containing pyritic sulfur is contacted with an oxidizing gas under wet oxidation conditions to produce a product mixture containing treated oil shale solids, and a liquid portion. Hydrocarbonaceous liquid is recovered from the product mixture.

15 Claims, No Drawings

OIL SHALE WET OXIDATION PROCESS

This invention relates to oil shale. In one aspect this invention relates to oil shale containing pyritic sulfur. In one of its aspects this invention relates to the recovery of hydrocarbonaceous liquid from oil shale. In another of its aspects this invention relates the removal of pyritic sulfur from oil shale. In a more particular aspect this invention relates to the use of a wet oxidation process.

Oil shale, because it is abundant and contains about 15 percent organic matter, has been extensively studied as a source of hydrocarbonaceous liquids. Major efforts have been made to investigate means for efficiently and economically obtaining hydrocarbonaceous liquid from oil shale.

Investigative experimentation into means for obtaining hydrocarbonaceous liquid from oil shale has, in the past, focused on destructive pyrolysis or retorting. It has proved extemely difficult, however, to recover hydrocarbonaceous liquid from oil shale using pyrolysis techniques because oil shale often contains pyritic sulfur which inhibits the recovery of the hydrocarbonaceous liquid.

It is, therefore, an object of this invention to provide a process for the recovery of hydrocarbonaceous liquid from oil shale. It is a further object of this invention to provide an economical and effective process for the recovery of hydrocarbonaceous liquid from oil shale. It is still another object of this invention to provide a process for recovering hydrocarbonaceous liquid from oil shale that uses less energy than known pyrolytic processes and that, at least, ameliorates the problem caused by the presence of pyritic sulfur by removing at least a portion of the pyritic sulfur from the oil shale.

Other aspects, objects and the various advantages of this invention will become apparent upon reading the specification and studying the claims.

SUMMARY OF THE INVENTION

In accordance with this invention, a process is provided for producing hydrocarbonaceous liquid from oil shale by wet oxidation techniques in which a reaction mixture of an aqueous slurry of comminuted oil shale containing pyritic sulfur is contacted with an oxidizing gas at oxidation conditions with sufficient agitation to produce a product mixture comprising treated shale solids and an aqueous liquid portion. The treated shale solids are separated from the liquid portions of the product mixture and the liquid portions are then separated to provide a non-aqueous liquid portion, i.e., a hydrocarbonaceous liquid, as product.

In a further embodiment of the invention the liquid portion of the product mixture after removal of the treated shale solids is separated preferably by a distillation operation that takes overhead the aqueous portion leaving a mixture of hydrocarbonaceous liquids and solid salts.

In a most preferred embodiment the wet oxidation process is carried out at oxidizing conditions to produce treated shale solids that can contain at least a portion of the original oil bearing material, kerogen, content but which have a reduced pyritic sulfur content as compared to the pyritic sulfur content before treatment. These treated shale solids can then be further treated for recovery of hydrocarbonaceous liquid. The further treatment can be by a repetition of the wet oxidation process or it can be by pyrolysis of the treated shale solids. Successful pyrolysis of the treated shale solids, referring to a success as recovery of hydrocarbon oil, should be facilitated by the lowering of the pyritic sulfur content of the treated shale. Whether the further treatment is carried out by further wet oxidation processing or by pyrolysis of the treated shale solids, overall recovery of hydrocarbonaceous liquid will have been accomplished probably with as great success and certainly with less expenditure of energy than could have been accomplished by processing the same oil shale solids containing pyritic sulfur by a pyrolytic process alone.

Wet oxidation processes are well known in the art. Prior to this invention, wet oxidation processes have been used to remove pyritic sulfur from coal and other fossil fuels, but the present invention is the first use of this process to recover hydrocarbonaceous liquid from oil shale or other forms of inorganic material containing kerogenous matter.

In general, the combination of operating conditions of temperature, pressure and time of treatment that are useful in this invention will provide for a partial removal of the organic material in the oil shale as a hydrocarbonaceous liquid product and will affect an at least partial removal of pyritic sulfur content of the oil shale. A combination of conditions strenuous enough to remove all of the pyritic sulfur can result in the destruction, i.e., oxidation of the hydrocarbon compounds that are sought as product.

The temperature of the oxidation process is in a range that will support oxidation with an upper limit of about 450° F. but is preferably in the range of about 100° F. and most preferably ranges from about 275° F. to about 325° F.

The oxidation is carried out at a pressure within the general range of about 100 psig to about 450 psig, more preferably in a range of about 200 psig to about 325 psig.

The time period during which contact is made between an aqueous slurry of comminuted oil shale and an oxidizing gas generally falls within the range of about 2 to about 6 hours, preferably from about 3 to about 5 hours. It should be noted here again that it is the combination of temperature, pressure and time of oxidation which is also affected by the degree of agitation that provides the optimum efficiency of this process by maximizing the recovery of hydrocarbon oil by minimizng the amount of contained kerogen that can be converted directly to oxides of carbon by a combination of processing conditions that is too strenuous.

In the process of this invention oil shale to be treated is first comminuted, i.e., crushed or otherwise reduced in size, to a particle size that can be readily processed as an aqueous slurry. The particle size of −100 mesh has been found to be advantageously useable, but larger particles can be used if proper agitation is provided.

The comminuted particles are slurried with enough water to allow the solid material to be easily agitated. Agitation is provided either by mechanical stirrers, by the sparging of steam into the process or by a combination of both these means of agitation. The stem can serve a dual purpose as a supply of agitation and heat. Heat can also be supplied by various heat exchange means.

The slurry of comminuted particles is heated to the desired temperature with agitation of the slurry to provide an even heating oxidizing gas when the gas is introduced into the slurry. An oxidizing gas is then introduced to admix with the slurry with the oxidizing gas supplying in part the pressure at which the reaction is controlled. The oxidizing gas is preferably and most efficiently oxygen, but mixtures of oxygen with inert gas, air, or other oxidizing gases can be used by adjusting the other operating conditions.

The wet oxidation process is carried out for a period of time to produce a product mixture that contains both aqueous liquid and non-aqueous liquid, i.e., hydrocarbonaceous liquid. Ideally, hydrocarbonaceous liquid will be produced with a minimum conversion of the kerogenous matter to oxidation products.

Although other means of recovery can be used, it is preferred to recover the hydrocarbon product by first physically separating the treated shale oil solids from the liquid in the product mixture and then distilling the liquid to take overhead the aqueous portion with a bottoms product comprising a hydrocarbon suspension of mineral salts that had been dissolved in the liquid and which would act as contaminants in the liquid product. The mineral salts are separated by filtration or any other means of separation known to those skilled in the art.

The treated oil shale solids that were separated from the product mixture can then be subjected to further treatnent for recovery of hydrocarbonaceous liquid preferably by either reslurring and carrying out further wet oxidation as described above or, since the wet oxidation is effective to reduce pyritic sulfur content of the oil shale, pyrolysis of the treated shale can be effectively carried out.

As noted before, wet oxidation is particularly effective for removal of hydrocarbonaceous liquid from Devonian shales such as those found in the Eastern United States because of the relatively high content of pyritic sulfur—up to 6 percent or more by weight—of the shales. To illustrate a process of this invention the following example is offereed in which hydrocarbon oil is recovered from Kentucky Eastern shale.

EXAMPLE

A one gallon sample of Kentucky Eastern shale having chunks of size up to 3 inches×3½ inches×1 inch was run through a jaw crusher and then through a motor driven corn grinder followed by sieving the ground product to remove all materiakl of −100 mesh. The +100 cut was then run through a Thomas Wiley mill, Model ED-5, with a 1 mm screen and the product sieved to remove the −100 cut. The +100 cut was then run through a Pieiser pulverizer, Model 500, and sieved to remove −100 material with repeating of this process until all material was −100 mesh mesh. About 3650 grams of total sample was recovered. The material was sampled for Fischer Assay.

Approximately 100 grams of −100 mesh Kentucky Eastern shale was charged to a reactor equipped with ascarite traps for collection of $CO_2$. 600 ml of deionized water were added to the reactor. Mechanical agitation was begun. Steam was admitted to the reactor jacket. Oxygen was admitted at a rate of 0.5 liter/minute and the temperature and pressure raised to and controlled at about 300° F. and about 300 psig respectively. Oxygen addition was continued for 3 hours after reaching reaction conditions.

On discontinuation of the reaction the treated solids were separated from a liquid filtrate with repeated washing of the treated solids and collection of filtrate. The filtrate from the wet oxidation was distilled using a standard microstill setup with all the water being taken overhead. Considerable solids were isolated during the distillation and an oil was isolated from the liquid product which, by Fischer Assay, amounted to roughly about 40 percent of the organic carbon in the starting shale.

Analysis of the treated solids showed that pyritic sulfur was essentially removed, but Fischer Assay of the treated shale showed no oil produced on pyrolysis.

The results of the tests set out above show that a quantity of oil was liberated by the wet oxidation process with the shale heated only to about 300° F. rather than the 1,000° F. usually required in pyrolysis operations. This example illustrates the recovery of hydrocarbon oil from oil shale by wet oxidation process.

That which is claimed is:

1. A process for producing hydrocarbonaceous liquid from oil shale be wet oxidation comprising:

(a) contacting (1) a reaction mixture of an aqueous slurry of comminuted oil shale containing pyritic sulfur and (2) oxidizing gas with sufficient agitation at oxidation conditions comprising a temperature of about 275° F. to about 325° F. to provide a product mixture comprising treated oil shale and liquid portion said liquid portion comprising hydrocarbonaceous liquid, water, and dissolved mineral salts;

(b) separating treated shale solids from the liquid portion of the product mixture; and (c) recovering a hyrocarbonaceous liquid from the liquid portion of the product mixture.

2. A process of claim 1 wherein the said hydrocarbonaceous liquid portion is recovered from the liquid portion by (a) distilling said liquid portion thereby taking overhead the water and leaving a bottoms product comprising hydrocarbonaceous liquid and mineral salts;

(b) separating hydrocarbonaceous liquid from mineral salts; and (c) recovering hydrocarbonaceous liquid product.

3. A process of claim 1 wherein said oxidation is carried out at oxidizing conditions of temperature of up to about 450° F. and pressure of up to about 500 psig for a time in the range of about 2 to about 6 hours.

4. A process of claim 2 wherein said oxidation is carried out at oxidizing conditions comprising pressure of up to about 500 psig for a time in the range of about 2 to about 6 hours.

5. A process of claim 3 wherein said pressure is in a range of about 100 psig to about 450 psig.

6. A process of claim 4 wherein said pressure is in a range of about 100 psig to about 450 psig.

7. A process of claim 1 wherein said oxidizing conditions produce treated shale solids containing kerogen and having reduced pyritic sulfur content as compared to said shale before treatment.

8. A process of claim 3 wherein said oxidizing conditions produce treated shale products containing kerogen and having reduced pyritic sulfur content as compared to said shale before treatment.

9. A process of claim 5 wherein said oxidizing conditions produce treated shale solids containing kerogen and having reduced pyritic sulfur content as compared to said shale before treatment.

10. A process of claim 7 wherein said treated shale solids are subjected to further treatment for producing hydrocarbonaceous liquid.

11. A process of claim 8 wherein said treated shale solids are subjected to further treatment for producing hydrocarbonaceous liquid.

12. A process of claim 9 wherein said treated shale solids are subjected to further treatment for producing hydrocarbonaceous liquid.

13. A process of claim 10 wherein said further treatment is a destructive pyrolysis of said treated shale solids.

14. A process of claim 11 wherein said further treatment is a destructive pyrolysis of said treated shale solids.

15. A process of claim 12 wherein said further treatment is a destructive pyrolysis of said treated shale solids.

* * * * *

UNITED STATES PATENT AND TRADEMARK OFFICE

CERTIFICATE OF CORRECTION

PATENT NO. : 4,891,132

DATED : JANUARY 2, 1990

INVENTOR(S) : EDWARD I. CZENKUSCH

It is certified that error appears in the above-identified patent and that said Letters Patent is hereby corrected as shown below:

Claim 3, column 4, line 42, after "oxidizing conditions" the phrase "of temperature of up to about 450°F. and" should be deleted, and insert --comprising--

Claim 8, column 4, line 59, "products" should be deleted and "solids" inserted therefor.

Signed and Sealed this

Twenty-fourth Day of September, 1991

*Attest:*

HARRY F. MANBECK, JR.

*Attesting Officer*

*Commissioner of Patents and Trademarks*